US007263851B2

(12) United States Patent
Yun et al.

(10) Patent No.: US 7,263,851 B2
(45) Date of Patent: Sep. 4, 2007

(54) REFRIGERATOR

(75) Inventors: Young-Hoon Yun, Daegu (KR); Tae-Hee Lee, Seoul (KR); Yong-Gu Kim, Seoul (KR); Dong-Hoon Lee, Incheon (KR)

(73) Assignee: LG Electronics Inc., Seoul (KR)

( * ) Notice: Subject to any disclaimer, the term of this patent is extended or adjusted under 35 U.S.C. 154(b) by 127 days.

(21) Appl. No.: 11/019,358

(22) Filed: Dec. 23, 2004

(65) Prior Publication Data

US 2005/0257552 A1 Nov. 24, 2005

(30) Foreign Application Priority Data

May 18, 2004 (KR) ..... 10-2004-0035351

(51) Int. Cl.
*F25D 19/00* (2006.01)

(52) U.S. Cl. ..... 62/295; 181/207; 248/678; 417/363

(58) Field of Classification Search ..... 62/295; 248/615, 678; 181/207, 209; 417/363
See application file for complete search history.

(56) References Cited

U.S. PATENT DOCUMENTS 2,498,028 A * 2/1950 Clerc ..... 62/284
2,660,037 A * 11/1953 Cooper ..... 62/295
2,685,178 A * 8/1954 Eck ..... 62/295
4,497,183 A * 2/1985 Gelbard et al. ..... 62/295
4,789,121 A * 12/1988 Gidseg et al. ..... 248/188.2
5,277,554 A * 1/1994 Elson ..... 417/363
5,306,121 A * 4/1994 Heflin et al. ..... 417/363
5,839,295 A * 11/1998 Lehmann ..... 62/498
5,913,892 A * 6/1999 Kwon ..... 62/296
6,260,373 B1 * 7/2001 Rockwood ..... 62/295
2005/0265857 A1 * 12/2005 Lee et al. ..... 417/363

* cited by examiner

*Primary Examiner*—William E. Tapolcai
(74) *Attorney, Agent, or Firm*—Birch, Stewart, Kolasch & Birch, LLP

(57) ABSTRACT

A refrigerator comprises: a body having a storage chamber and a mechanical chamber; a base plate arranged in the mechanical chamber without a direct contact with the body, and having a compressor; a first supporting member coupled to the body and supporting the body; and a second supporting member installed at a bottom of the base plate and supporting the base plate. A load of the body and a load of components inside the mechanical chamber are individually supported, so that vibration generated from the compressor, etc. is prevented from being transmitted to the body.

19 Claims, 9 Drawing Sheets

REFRIGERATOR

BACKGROUND OF THE INVENTION

1. Field of the Invention

The present invention relates to a refrigerator, and more particularly, to a refrigerator capable of preventing vibration of a mechanical chamber from being transmitted to a body.

2. Description of the Conventional Art

As shown in FIGS. 1 and 2, a refrigerator in accordance with the conventional art comprises: a body 10 having a storage chamber (not shown) for storing refrigerating items or freezing items and a mechanical chamber 20 for arranging mechanical components such as a compressor 35, etc. therein; a door 30 hinge-connected to the body 10, for opening and closing the storage chamber; a covering plate 21 fixed to a lower portion of a rear side of the body 10 by a screw 23, for covering the mechanical chamber 20; and a base plate 31 integrally coupled to a lower side of the body 10, for supporting a load of the body 10 and a load of mechanical components such as the compressor, etc.

A control box 25 for controlling an operation of the refrigerator, a tray 27 for accommodating defrosted water generated by a defrosting operation of the refrigerator, etc. are provided in the mechanical chamber 20.

A suction pipe 39 for introducing a refrigerant and a discharge pipe 38 for discharging a compressed refrigerant are connected to the compressor 35. Also, a dryer 36 for removing moisture inside a pipe 34 is installed at the pipe 34 for connecting the compressor 35, a condenser (not shown), and an evaporator (not shown).

The base plate 31 is fixed to a lower side of the body 10 by a screw 32, a fixing member 37 for fixing the compressor 35 is installed at an upper side of the base plate 31, and a supporting roller 17 for movably supporting the body 10 is installed at a lower side of the base plate 31.

According to this, the base plate 31 provided with the supporting roller 17 supports not only a load of the body 10 but also a load of mechanical components including the compressor 35 inside the mechanical chamber 20 at a floor.

However, in the conventional refrigerator, since the base plate 31 is integrally fixed to the lower portion of the rear side of the body 10 by the screw 32 and supports not only a load of the body 10 but also a load of mechanical components including the compressor 35 inside the mechanical chamber 20 at a floor, vibration generated as the compressor 35 is operated is transmitted to the body 10 through the base plate 31 and the screw 32. According to this, components requiring comparatively less vibration can not be stored in the refrigerator.

SUMMARY OF THE INVENTION

Therefore, an object of the present invention is to provide a refrigerator capable of preventing vibration generated from a compressor, etc. from being transmitted to a body by individually supporting not only a load of the body but also a load of mechanical components including a compressor inside a mechanical chamber at a floor.

Another object of the present invention is to provide a refrigerator capable of integrally transferring mechanical components inside the mechanical chamber with the body without an error at the time of transferring the refrigerator by providing a connection unit for elastically connecting the body and the base plate, and capable of preventing a damage of components by absorbing an impact generated at the time of transferring the refrigerator.

To achieve these and other advantages and in accordance with the purpose of the present invention, as embodied and broadly described herein, there is provided a refrigerator comprising: a body having a storage chamber and a mechanical chamber; a base plate arranged in the mechanical chamber without a direct contact with the body, and having a compressor; a first supporting member coupled to the body and supporting the body; and a second supporting member installed at a bottom of the base plate and supporting the base plate.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, preferred embodiments of the present invention will be explained with reference to the attached drawings.

Figure 1:
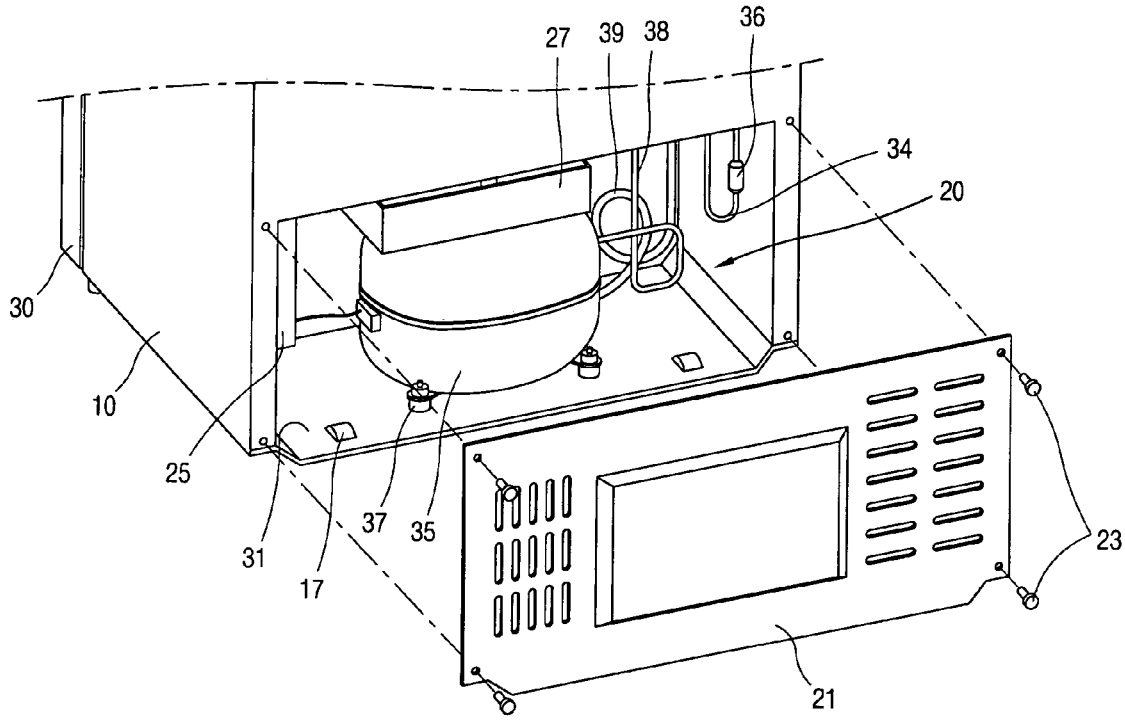
FIG. 1 CONVENTIONAL ART
FIG. 1 is a perspective view showing a mechanical chamber of a refrigerator in accordance with the conventional art.
Figure 2:
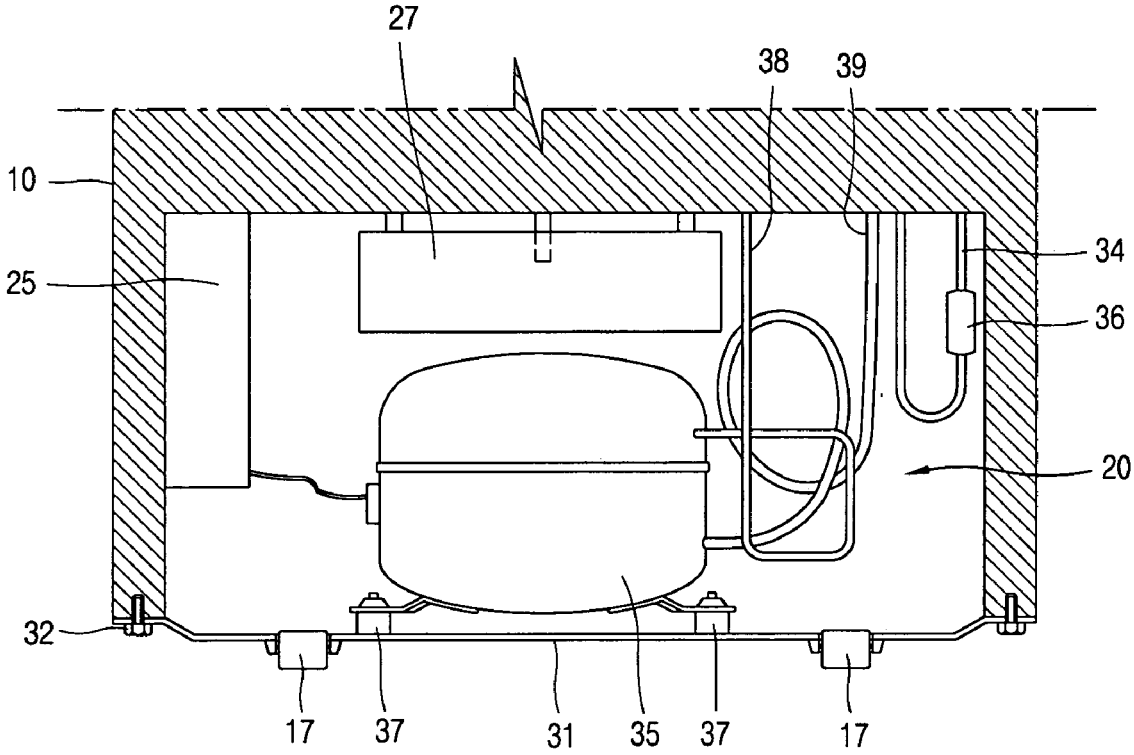
FIG. 2 CONVENTIONAL ART
FIG. 2 is a longitudinal section view showing the mechanical chamber of FIG. 1.
Figure 3:
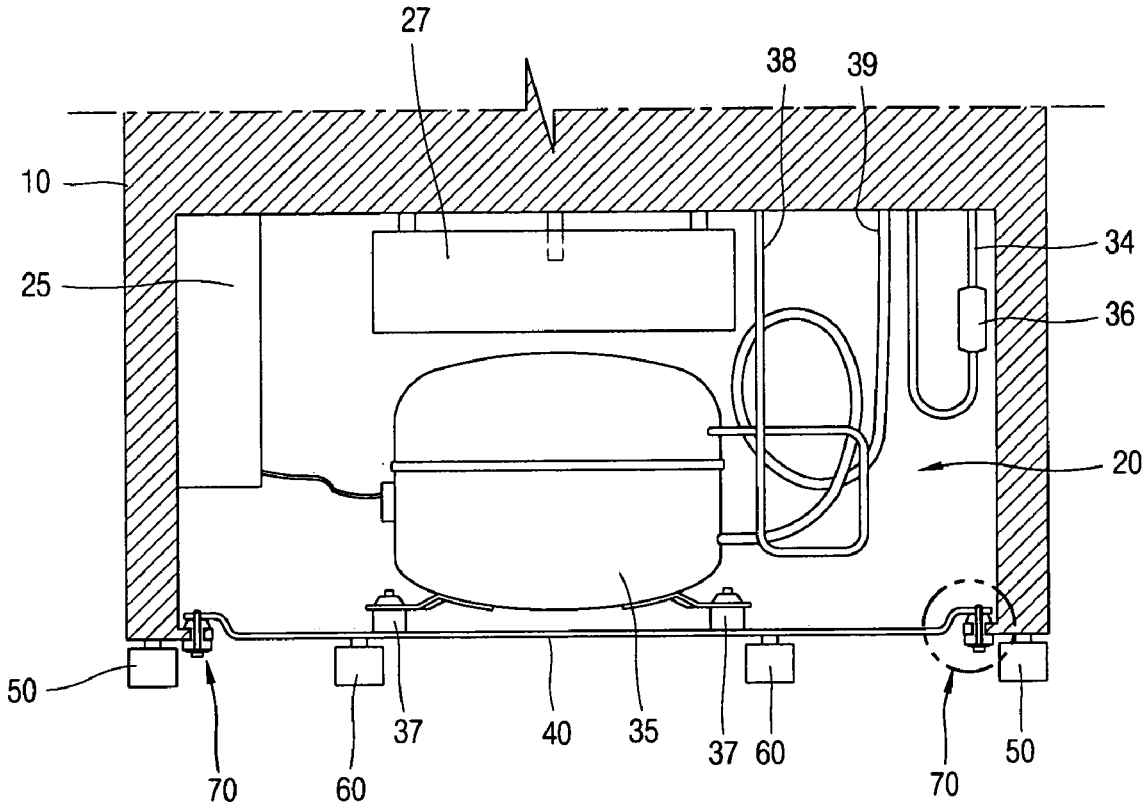
FIG. 3 is a longitudinal section view showing a mechanical chamber of a refrigerator according to one embodiment of the present invention.
Figure 4:
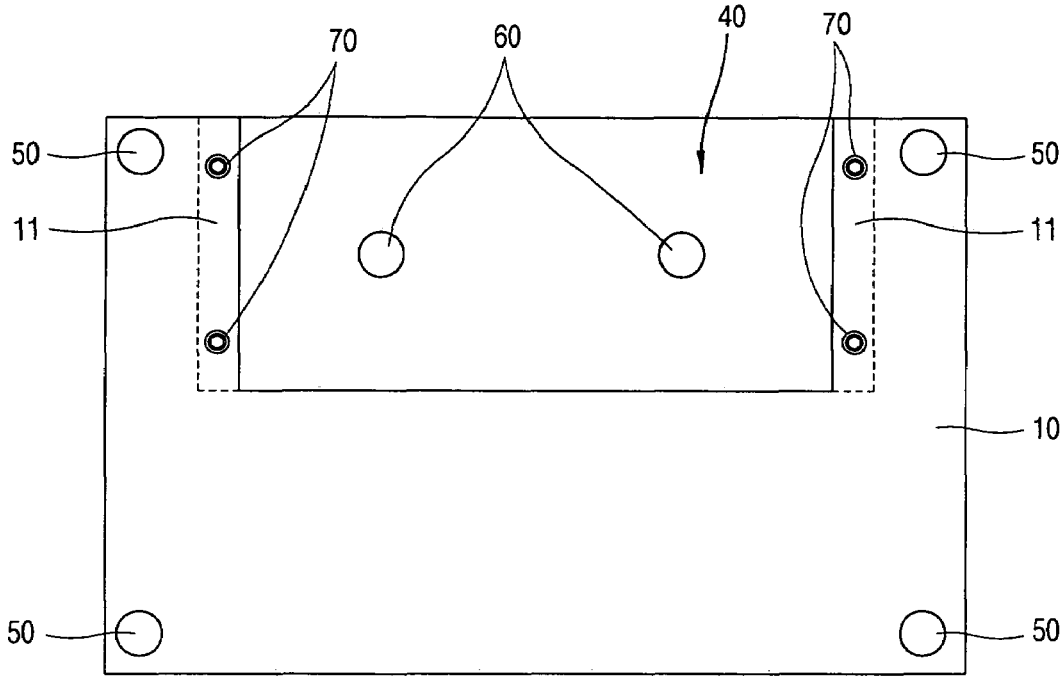
FIG. 4 is a bottom view showing the refrigerator of FIG. 3.

As shown in FIGS. 3 and 4, a refrigerator according to one embodiment of the present invention comprises: a body 10 having a storage chamber (not shown) for storing refrigerating items or freezing items and a mechanical chamber 20 for arranging mechanical components such as a compressor 35, etc. therein; a base plate 40 arranged in the mechanical chamber 20 without a direct contact with the body 10, and having mechanical components such as the compressor 35, etc.; a first supporting member 50 installed at a bottom of the body 10 and supporting the body 10 at a floor; a second supporting member 60 installed at a bottom of the base plate 40 and supporting the base plate 40 at a floor; and a connection unit 70 for elastically connecting the body 10 and the base plate 40, reciprocally.

A control box 25 for controlling an operation of the refrigerator, a tray 27 for accommodating defrosted water generated by a defrosting operation of the refrigerator, etc. are provided in the mechanical chamber 20.

A suction pipe 39 for introducing a refrigerant and a discharge pipe 38 for discharging a compressed refrigerant are connected to the compressor 35. Also, a dryer 36 for removing moisture inside a pipe 34 is installed at the pipe 34 for connecting the compressor 35, a condenser (not shown), and an evaporator (not shown).

The first supporting member 50 and the second supporting member 60 respectively support a load of the body 10 and the base plate 40 provided with mechanical components, and are respectively installed at a lower portion of the body 10 and at a lower portion of the base plate 40 by a coupling means such as a screw, etc. Preferably, the coupling means controls a height from a bottom of the body 10 and the base plate 40.

In the refrigerator according to the present invention, the body 10 that the first supporting member 50 and the second supporting member 60 does not directly come in contact with each other, and the base plate 40 are individually supported. According to this, vibration generated from components such as the compressor 35, etc. installed at the base plate 40 is prevented from being transmitted to the body 10.

The connection unit 70 enables mechanical components inside the mechanical chamber 20 to be integrally transferred with the body 10 without an error at the time of transferring the refrigerator. Also, the connection unit 70 prevents a damage of the components by absorbing an impact that may be generated while the refrigerator is transferred.

Figure 5:
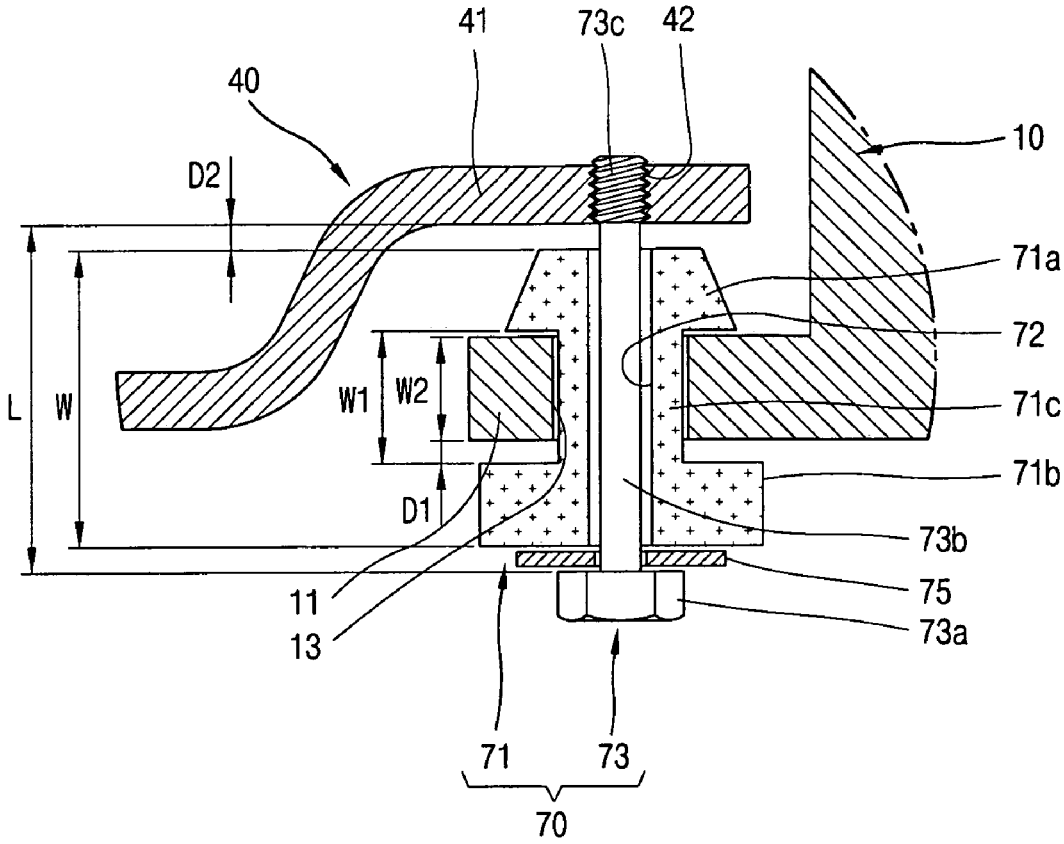
FIG. 5 is an enlarged view showing a connection unit of FIG. 3.

As shown in FIG. 5, the connection unit 70 is composed of: an elastic member 71 interposed between the body 10 and the base plate 40; and a coupling member 73 for coupling the body 10, the base plate 40, and the elastic member 71.

Flanges 11 and 41 are respectively extendingly formed at the body 10 and the base plate 40 so that the connection unit 70 can be installed therebetween. A through hole 13 for passing the elastic member 71 and the coupling member 73 is formed at the flange 11 of the body 10, and a coupling hole 42 having a cut screw thread and for coupling the coupling member 73 is formed at the flange 41 of the base plate 40.

The elastic member 71 is formed of an elastic material such as rubber, synthetic resin, etc., and a through hole 72 for passing the coupling member 73 is formed in the middle of the elastic member 71. The elastic member 71 is composed of: a first portion 71*a* interposed between the flange 11 of the body 10 and the flange 41 of the base plate 40; a second portion 71*b* interposed between the flange 11 of the body 10 and a head portion 73*a* of the coupling member 73 which will be later explained; and a third portion 71*c* having a diameter smaller than diameters of the first portion 71*a* and the second portion 71*b* and inserted into the through hole 13 of the flange 11 of the body 10, for connecting the first portion 71*a* and the second portion 71*b* each other.

An inclination surface of a certain angle is formed at a circumferential surface of the first portion 71*a* of the elastic member 71 so that the elastic member 71 can be easily inserted into the through hole 13 of the flange 11 of the body 10.

For the protection of a vibration transmission, it is preferable that a width W1 of the third portion 71*c* is greater than a thickness W2 of the flange 11 of the body 10 so that the first portion 71*a* and the second portion 71*b* can not be adhered to both surfaces of the flange 11 of the body 10. That is, a certain gap D1 is preferably maintained between the second portion 71*b* and the flange 11 of the body 10.

The coupling member 73 is composed of: a head portion 73*a*; a connection portion 73*b* extended from the head portion 73*a* thus to be inserted into the through hole 72 of the elastic member 71; and a screw portion 73*c* formed at the end of the connection portion 73*b* thus to be inserted into the coupling hole 42 of the flange 41 of the base plate 40.

For the protection of a vibration transmission, a length L of the connection portion 73*b* is preferably greater than an entire width W of the elastic member 71 so that the first portion 71*a* of the elastic member 71 can not be adhered to the flange 41 of the base plate 40. That is, a certain gap D2 is preferably maintained between the first portion 71*a* of the elastic member 71 and the flange 41 of the base plate 40. The length L of the connection portion 73*b* can be controlled by controlling the width of the screw portion 73*c*, that is, a width that the screw thread is cut.

A washer 75 is preferably fitted between the second portion 71*b* of the elastic member 71 and the head portion 73*a* of the coupling member 73.

Under the above construction, the first portion 71*a* of the elastic member 71 is fitted into the through hole 13 of the flange 11 of the body 10, and the height of the first supporting member 60 is controlled thereby to position the flange 41 of the base plate 40 at an upper side of the flange 11 of the body 10. Then, the coupling member 73 penetrates the through hole 72 of the elastic member 71, and the screw portion 73*c* of the coupling member 73 is coupled to the coupling hole 42 of the flange 41 of the base plate 40, thereby completing the process for connecting the base plate 40 to the body 10.

Figure 6:
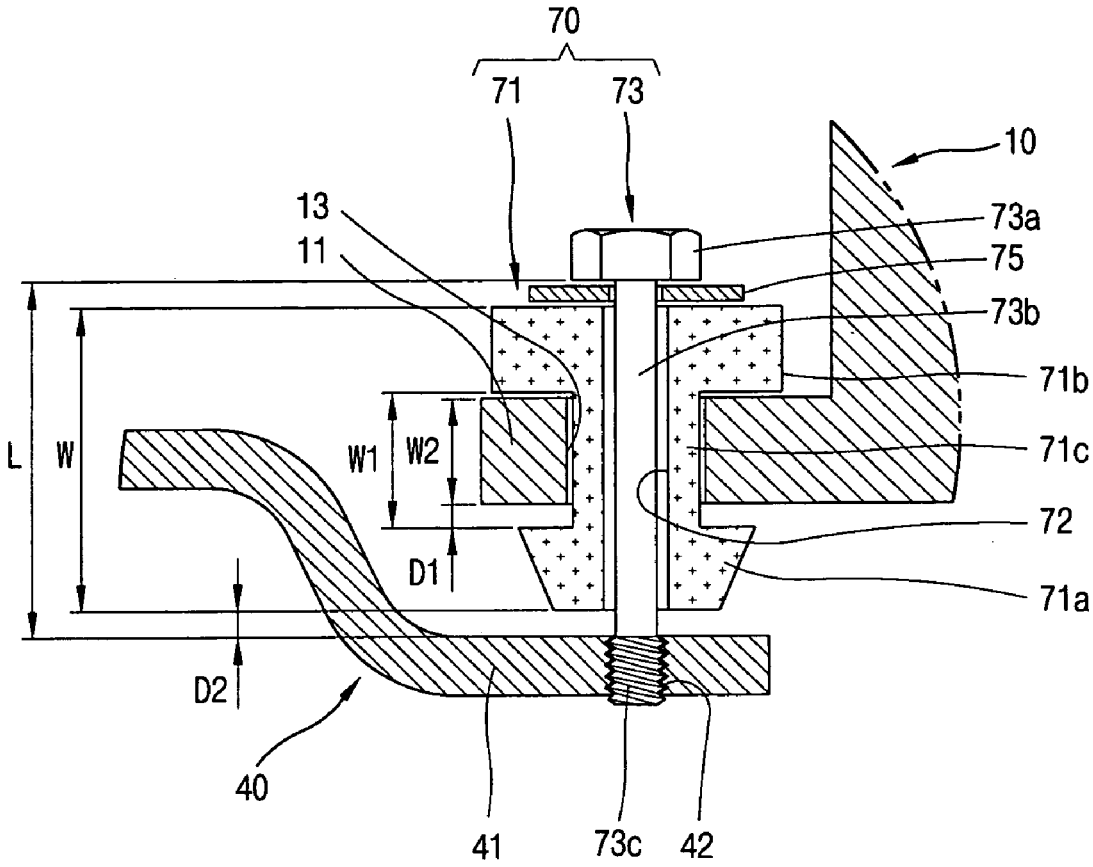
FIG. 6 is an enlarged view showing another example of a connection unit of FIG. 3.

As shown in FIG. 6, the flange 41 of the base plate 40 may be disposed below the flange 11 of the body 10. The structure of the connection unit 70 as depicted in FIG. 6 is similar to the above description.

In the refrigerator according to one embodiment of the present invention, the body 10 and the base plate 40 for supporting components such as the compressor 35, etc. inside the mechanical chamber 20 are individually supported at the floor by using the first and second supporting members 50 and 60, thereby preventing vibration generated from the compressor 35, etc. from being transmitted to the body 10.

Also, by providing the connection unit 70 for elastically connecting the body 10 and the base plate 40, mechanical components inside the mechanical chamber 20 can be integrally transferred with the body 10 without an error at the time of transferring the refrigerator. Also, by absorbing an impact generated while the refrigerator is transferred, a damage of the components can be prevented.

Hereinafter, a refrigerator according to another embodiment of the present invention will be explained with reference to FIGS. 7 to 9. The same reference numerals were given to the same parts as those of the aforementioned embodiment and their explanations will be omitted.

Figure 7:
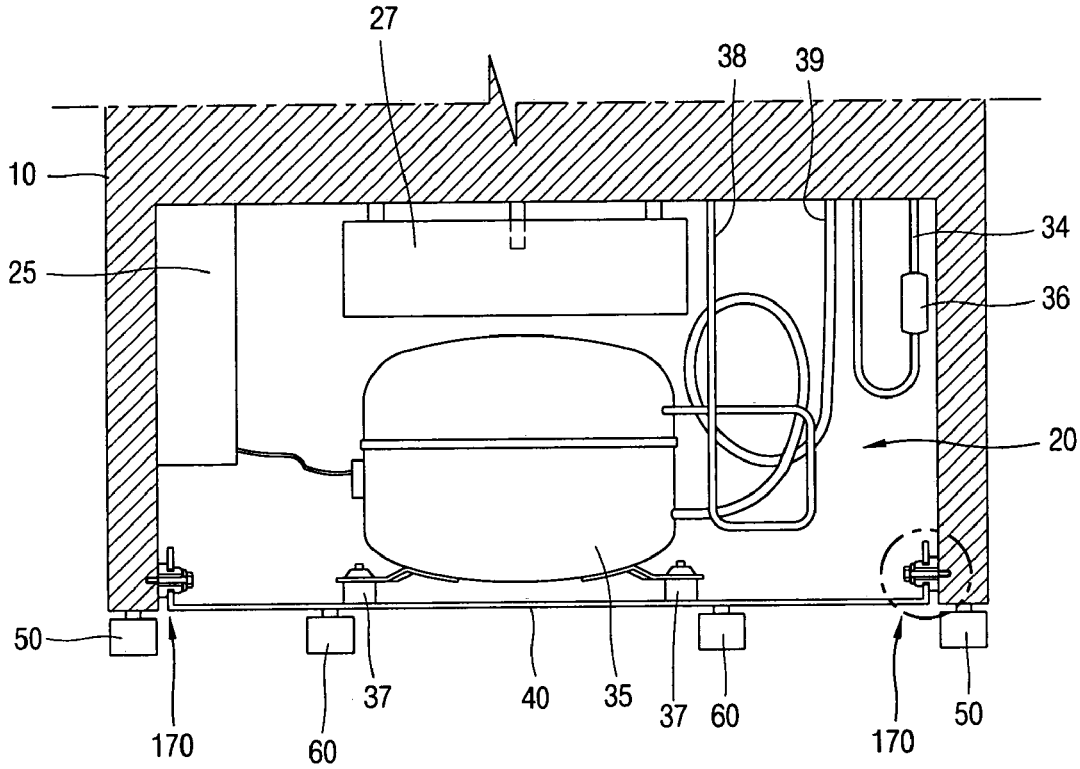
FIG. 7 is a longitudinal section view showing a mechanical chamber of a refrigerator according to another embodiment of the present invention.
Figure 8:
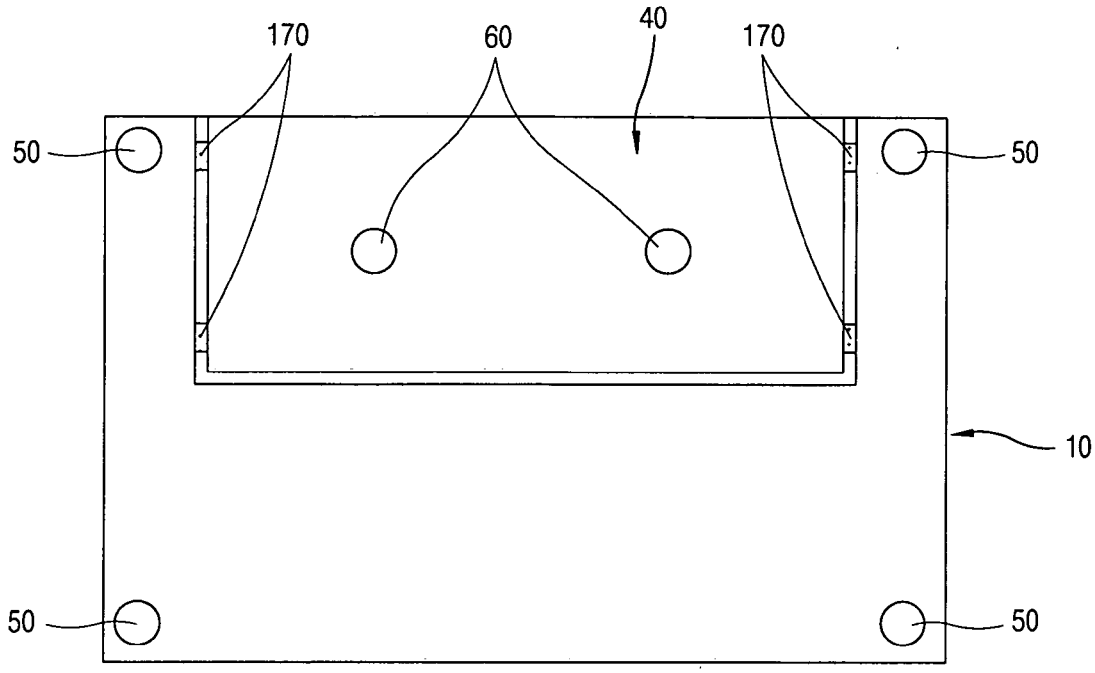
FIG. 8 is a bottom view showing the refrigerator of FIG. 7.

As shown in FIGS. 7 and 8, the refrigerator according to another embodiment of the present invention comprises: a body 10 having a storage chamber (not shown) for storing refrigerating items or freezing items and a mechanical chamber 20 for arranging mechanical components such as a compressor 35, etc. therein; a base plate 40 arranged in the mechanical chamber 20 without a direct contact with the body 10, for supporting mechanical components such as the compressor 35, etc.; a first supporting member 50 installed at a bottom of the body 10 and supporting the body 10 at a floor; a second supporting member 60 installed at a bottom of the base plate 40 and supporting the base plate 40 at a floor; and a connection unit 170 for elastically connecting the body 10 and the base plate 40, reciprocally.

The first supporting member 50 and the second supporting member 60 individually support the body 10 and the base plate 40.

Figure 9:
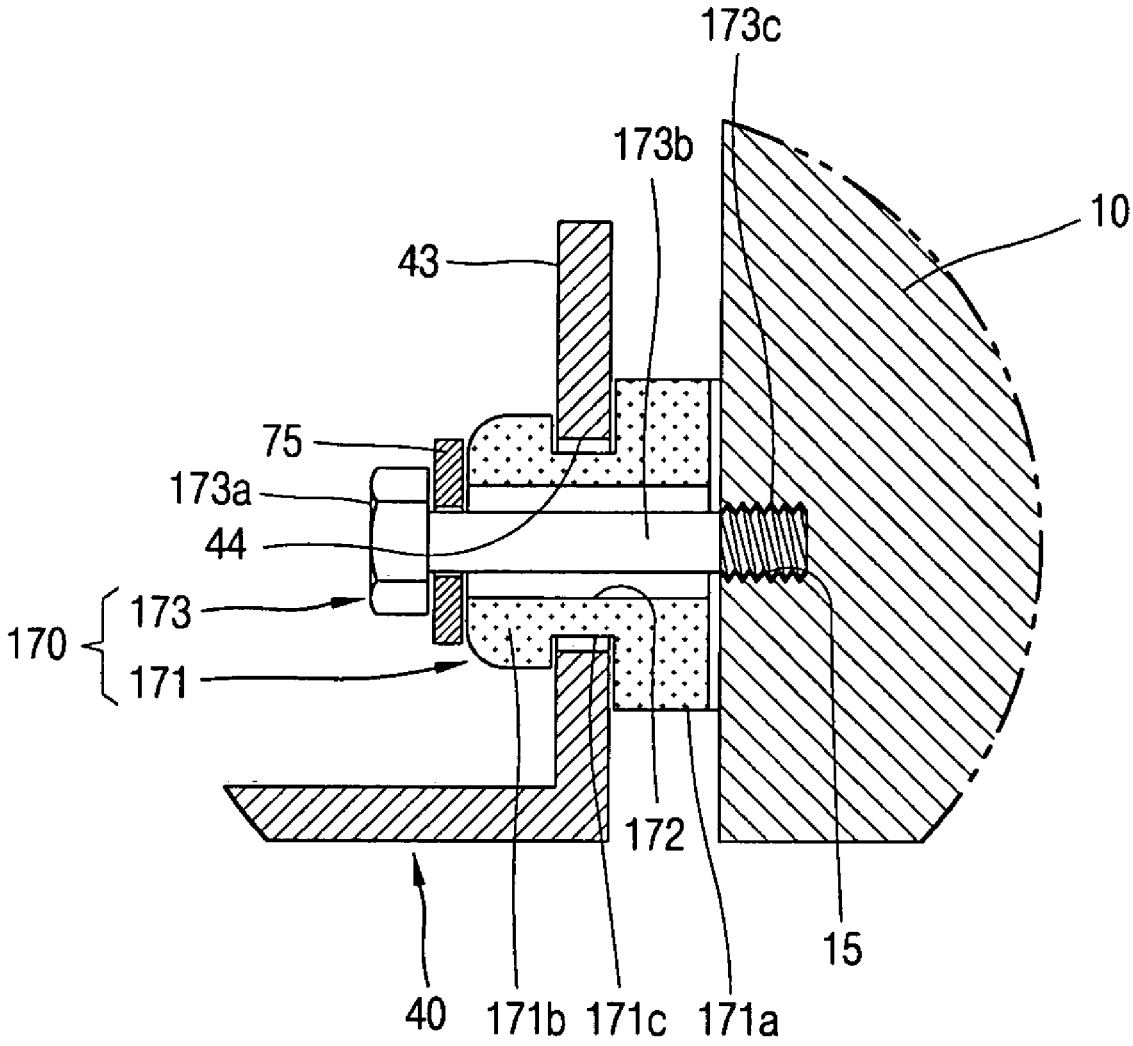
FIG. 9 is an enlarged view showing a connection unit of FIG. 7.

As shown in FIG. 9, the connection unit 170 is composed of: an elastic member 171 interposed between the body 10 and the base plate 40; and a coupling member 173 for coupling the body 10, the base plate 40, and the elastic member 171.

A coupling groove 15 having a screw thread and for coupling the coupling member 173 is formed at the body 10. A flange 43 having a certain gap from the body 10 is extendingly formed at the base plate 40 so that the elastic member 171 can be installed between the base plate 40 and the body 10. A through hole 44 for passing the elastic member 171 and the coupling member 173 is formed at the flange 43 of the base plate 40.

The elastic member 171 is formed of an elastic material such as rubber, synthetic resin, etc., and a through hole 172 for passing the coupling member 173 is formed in the middle of the elastic member 171. The elastic member 171 is composed of: a first portion 171*a* interposed between the body 10 and the flange 43 of the base plate 40; a second portion 171*b* interposed between the flange 43 of the base plate 40 and a head portion 173*a* of the coupling member 173; and a third portion 171*c* having a diameter smaller than diameters of the first portion 171*a* and the second portion 171*b* and inserted into the through hole 44 of the flange 43 of the base plate 40, for connecting the first portion 171*a* and the second portion 171*b* each other.

An inclination surface of a certain angle is formed at a circumferential surface of the first portion 171*a* of the elastic member 171 so that the elastic member 171 can be easily inserted into the through hole 44 of the flange 43 of the base plate 40.

For the protection of a vibration transmission, it is preferable that a width of the third portion 171*c* is greater than a thickness of the flange 43 of the base plate 40 so that the first portion 171*a* and the second portion 171*b* can not be adhered to both surfaces of the flange 43 of the base plate 40. That is, a certain gap is preferably maintained between the first and second portions 171*a* and 172*b* and the flange 43 of the base plate 40.

The coupling member 173 is composed of: a head portion 173*a*; a connection portion 173*b* extended from the head portion 173*a* thus to be inserted into the through hole 172 of the elastic member 171; and a screw portion 173*c* formed at the end of the connection portion 173*b* thus to be inserted into the coupling groove 15 of the body 10.

For the protection of a vibration transmission, a length of the connection portion 173*b* is preferably greater than an entire width of the elastic member 171 so that the elastic member 171 can not be adhered to the head portion 173*a* of the coupling member 173 or the body 10. That is, a certain gap is preferably maintained between the elastic member 171 and the head portion 173*a* of the coupling member 173 and between the elastic member 171 and the body 10. The length of the connection portion 173*b* can be controlled by controlling the width of the screw portion 173*c*, that is, a width that the screw thread is cut.

Under the above construction, the elastic member 171 is fitted into the flange 43 of the base plate 40, and the height of the first supporting member 60 is controlled thereby to position the flange 43 of the base plate 40 near the body 10 so that the through hole 172 of the elastic member 171 can be connected to the coupling groove 15 of the body 10. Then, the coupling member 173 penetrates the through hole 172 of the elastic member 171, and the screw portion 173*c* of the coupling member 173 is coupled to the coupling groove 15 of the body 10, thereby completing the process for connecting the base plate 40 to the body 10.

Meanwhile, the shape of the flange 43 is not limited to the structure shown in FIG. 9, but the flange 43 may be extended downward from the base plate 40.

In the refrigerator according to another embodiment of the present invention, the flange 43 is formed only at the base plate 40 in order to connect the base plate 40 to the body 10. According to this, the structure of the body 10 is simplified and the fabrication process is simplified.

Effects of the refrigerator according to another embodiment of the present invention is the same as those of the aforementioned embodiment.

In the refrigerator according to another embodiment of the present invention, the body and the base plate where components such as the compressor, etc. inside the mechanical chamber are individually installed at the floor. According to this, vibration generated from the compressor, etc. can be prevented from being transmitted to the body.

Also, since the connection unit for elastically connecting the body and the base plate is provided, the mechanical components inside the mechanical chamber can be integrally transferred with the body at the time of transferring the refrigerator.

Additionally, since the elastic member is provided at the connection unit, an impact generated while the refrigerator is transferred is absorbed thus to prevent a damage of the components. By the elastic member, vibration of the compressor, etc. can be prevented from being transmitted to the body.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A refrigerator comprising:

a body having a storage chamber and a mechanical chamber;

a base plate arranged in the mechanical chamber without a direct contact with the body, and supporting a compressor;

a first supporting member having one end coupled to the body, and the other end contacted with a floor, for supporting the body;

a second supporting member having one end installed at a bottom of the base plate, and the other end contacted with the floor, for supporting the base plate; and a connection unit for elastically connecting the body and the base plate.

2. The refrigerator of claim 1, wherein the connection unit is composed of:

an elastic member interposed between the body and the base plate; and a coupling member for coupling the body, the base plate, and the elastic member.

3. The refrigerator of claim 2, wherein flanges are respectively extended from the body and the base plate so that the connection unit can be installed therebetween.

4. The refrigerator of claim 3, wherein a through hole for passing the elastic member and the coupling member is formed at the flange of the body, and a coupling hole having a screw thread and for coupling the coupling member is formed at the flange of the base plate.

5. The refrigerator of claim 4, wherein the coupling member is composed of:

a head portion;

a connection portion extended from the head portion and passing through a through hole formed in a center of the elastic member; and a screw portion formed at an end of the connection portion thus to be inserted into the coupling hole of the flange of the base plate.

6. The refrigerator of claim 5, wherein the elastic member is composed of:

a first portion interposed between the flange of the body and the flange of the base plate, a second portion interposed between the flange of the body and the head portion of the coupling member; and a third portion having a diameter smaller than diameters of the first portion and the second portion and inserted into the through hole of the flange of the body, for connecting the first portion and the second portion to each other.

7. The refrigerator of claim 6, wherein a width of the third portion is greater than a thickness of the flange of the body so that the first portion and the second portion can not be adhered to both surfaces of the flange of the body.

8. The refrigerator of claim 6, wherein a length of the connection portion is greater than an entire width of the elastic member so that the first portion of the elastic member can not be adhered to the flange of the base plate.

9. The refrigerator of claim 2, wherein a coupling groove having a screw thread and for coupling the coupling member is formed at the body, a flange having a certain gap from the body is extended from the base plate so that the elastic member can be installed between the base plate and the body, and a through hole for passing the elastic member and the coupling member is formed at the flange of the base plate.

10. The refrigerator of claim 9, wherein the coupling member is composed of:

a head portion;

a connection portion extended from the head portion and passing through a through hole formed in a center of the elastic member; and a screw portion formed at an end of the connection portion to be inserted into the coupling groove of the body.

11. The refrigerator of claim 10, wherein the elastic member is composed of:

a first portion interposed between the body and the flange of the base plate;

a second portion interposed between the flange of the base plate and the head portion of the coupling member; and a third portion having a diameter smaller than diameters of the first portion and the second portion and inserted into the through hole of the flange of the base plate, for connecting the first portion and the second portion to each other.

12. The refrigerator of claim 11, wherein a width of the third portion is greater than a thickness of the flange of the base plate so that the first portion and the second portion can not be adhered to both surfaces of the flange of the base plate.

13. The refrigerator of claim 11, wherein a length of the connection portion is greater than an entire width of the elastic member so that the elastic member can not be adhered to the head portion of the coupling member or the body.

14. The refrigerator of claim 2, wherein the elastic member is composed of:

a first portion interposed between the body and the base plate, a second portion interposed between the body and a head portion of the coupling member; and a third portion having a diameter smaller than diameters of the first portion and the second portion and inserted into a through hole of the body, for connecting the first portion and the second portion to each other.

15. The refrigerator of claim 1, wherein the connecting unit is independent of the second support member.

16. A refrigerator comprising:

a body having a storage chamber and a mechanical chamber;

a base plate arranged in the mechanical chamber without a direct contact with the body, and supporting a compressor;

a first supporting member having one end coupled to the body, and the other end contacted with a floor, for supporting the body; and a second supporting member having one end installed at a bottom of the base plate, and the other end contacted with the floor, for supporting the base plate.

17. The refrigerator of claim 16, further comprising a connection unit for elastically connecting the body and the base plate.

18. The refrigerator of claim 17, wherein the connection unit is composed of:

an elastic member interposed between the body and the base plate; and a coupling member for coupling the body, the base plate, and the elastic member.

19. The refrigerator of claim 18, wherein flanges are respectively extended from the body and the base plate so that the connection unit is installed therebetween.

* * * * *